US011112166B2

(12) United States Patent
Claass et al.

(10) Patent No.: US 11,112,166 B2
(45) **Date of Patent: *Sep. 7, 2021**

(54) DOOR RACK HAVING A BOTTOM LATCHED ON A BASIC BODY, AND DOMESTIC REFRIGERATION APPLIANCE HAVING A DOOR RACK

(71) Applicant: BSH HAUSGERAETE GMBH, Munich (DE)

(72) Inventors: Elena Claass, Geislingen (DE); Andrea Fink, Gerstetten (DE); Stefan Deissler, Noerdlingen (DE)

(73) Assignee: BSH Hausgeraete GmbH, Munich (DE)

( * ) Notice: Subject to any disclaimer, the term of this patent is extended or adjusted under 35 U.S.C. 154(b) by 15 days.

This patent is subject to a terminal disclaimer.

(21) Appl. No.: 16/466,182

(22) PCT Filed: Dec. 8, 2017

(86) PCT No.: PCT/EP2017/082060
§ 371 (c)(1),
(2) Date: Jun. 3, 2019

(87) PCT Pub. No.: WO2018/114405
PCT Pub. Date: Jun. 28, 2018

(65) Prior Publication Data

US 2020/0072535 A1 Mar. 5, 2020

(30) Foreign Application Priority Data

Dec. 20, 2016 (DE) ..... 102016225610.6

(51) Int. Cl.
*F25D 25/02* (2006.01)
*F25D 11/00* (2006.01)
*F25D 23/02* (2006.01)

(52) U.S. Cl.
CPC ..... *F25D 25/02* (2013.01); *F25D 11/00* (2013.01); *F25D 23/028* (2013.01)

(58) Field of Classification Search
CPC ..... F25D 25/02; F25D 11/00; F25D 23/028
(Continued)

(56) References Cited

U.S. PATENT DOCUMENTS 2,201,114 A * 5/1940 Peltier ..... F25D 25/02 108/157.13
2,453,387 A * 11/1948 Rundell ..... F25D 23/04 312/248

(Continued)

FOREIGN PATENT DOCUMENTS

DE 102011006798 A1 10/2012
WO 2013050399 A2 4/2013
WO 2013182429 A1 12/2013

*Primary Examiner* — Daniel J Troy
*Assistant Examiner* — Timothy M Ayres
(74) *Attorney, Agent, or Firm* — Laurence A. Greenberg; Werner H. Stemer; Ralph E. Locher

(57) ABSTRACT

A door rack for a domestic refrigeration appliance has a basic body which is configured for receiving items to be stored, a rear wall and a forwardly oriented upper bow directed away from the rear wall of the basic body. A plate which is separate from the basic body forms the bottom of the door rack and is latched on the basic body by way of a latching device. A reach-through region is formed between the upper bow and the plate in the end position of the plate in which it is arranged on the basic body. There is also described a domestic refrigeration appliance having a door rack.

12 Claims, 5 Drawing Sheets

(58) Field of Classification Search
USPC ..... 312/257.1, 263, 265.5, 265.6, 348.1, 312/348.2, 405.1
See application file for complete search history.

(56) References Cited

U.S. PATENT DOCUMENTS 2,780,926 A * 2/1957 Sharpe ..... F25D 25/024 62/382
2,784,044 A * 3/1957 Kurowski ..... F25D 23/04 312/405.1
3,682,521 A * 8/1972 Kesling ..... F25D 23/04 312/321.5
3,709,576 A * 1/1973 Lemoine ..... F25D 23/04 312/321.5
3,752,553 A * 8/1973 Bildahl ..... A47B 88/95 312/265.1
4,921,315 A * 5/1990 Metcalfe ..... A47B 96/16 312/321.5
5,004,305 A * 4/1991 Montuoro ..... F25D 23/04 312/350
5,647,181 A * 7/1997 Hunts ..... A63H 33/10 312/111
5,799,803 A * 9/1998 Muller ..... A47F 5/0043 108/108
6,824,232 B2 * 11/2004 Farmer ..... A47B 88/00 312/293.2
7,200,899 B2 * 4/2007 Sagol ..... A47B 47/00 24/295
7,681,746 B2 * 3/2010 Schmidt ..... A47F 5/005 211/184
8,562,089 B2 * 10/2013 Collins ..... F25D 23/04 312/405.1
8,590,993 B2 * 11/2013 Lee ..... F25D 25/025 312/404
8,616,665 B2 * 12/2013 Czach ..... F25D 23/04 312/404
9,239,185 B2 * 1/2016 Park ..... A47B 88/477
10,113,787 B2 * 10/2018 Claass ..... F25D 23/02
10,451,097 B2 * 10/2019 Brannstrom ..... F16B 12/10
2008/0067910 A1 * 3/2008 Butler ..... F25D 25/02 312/408
2009/0039749 A1 * 2/2009 Gerstner ..... F25D 23/04 312/404
2010/0109496 A1 * 5/2010 Grasy ..... F25D 23/04 312/404

* cited by examiner

DOOR RACK HAVING A BOTTOM LATCHED ON A BASIC BODY, AND DOMESTIC REFRIGERATION APPLIANCE HAVING A DOOR RACK

BACKGROUND OF THE INVENTION

Field of the Invention

The invention relates to a door rack for a household refrigeration appliance. The door rack has a basic body which is designed for receiving items to be stored. The invention further relates to a household refrigeration appliance having at least one such door rack.

Door racks for household refrigeration appliances are known in many different configurations. Door racks may be designed as a unitary part or in multiple parts. In the case of multipart configurations of door racks, which are therefore constructed from at least two separate components, provision is usually made for the door rack to be covered by lateral and frontal boundary walls. The accessibility in the case of such configurations is then only possible via an opening at the top, via which items to be stored can be introduced into or taken from the door rack. Accessibility and ease of use are thereby restricted.

SUMMARY OF THE INVENTION

The object of the present invention is to create a door rack which is more variable in respect of its accessibility, while nonetheless being constructed in a mechanically stable manner in its multipart configuration.

This object is achieved by a door rack and a household refrigeration appliance as claimed in the independent claims.

One aspect of the invention relates to a door rack for a household refrigeration appliance. The door rack has a basic body, which is designed for receiving items to be stored. The basic body has a rear wall and a forwardly oriented upper bow directed away from the rear wall of the basic body. The bow is so designed as to be continuous and uninterrupted, and converges at both ends with specific regions of the basic body. The door rack has a plate which is separate from the basic body and can be attached thereto as a bottom of the door rack. A latching device is formed as an attachment device, such that said bottom is latched onto the basic body. In the end position of the plate, said end position being arranged in the basic body, viewed in an upward and therefore vertical direction of the door rack, an uncovered and exposed and therefore permanently unencumbered reach-through region is formed between the bow and the plate. In its installed state, the plate is therefore designed to be situated at a distance from said upper bow, and it is possible to reach through the reach-through region from the outside. By virtue of such a configuration, a door rack is created which is constructed from multiple parts but the number of parts is nonetheless minimized. By virtue of the specific configuration of the basic body, this is also mechanically stable and is so developed as to be torsionally rigid in itself. In particular, this is also made possible by the bow. The position of the bow as an upper bow also further assists this mechanical stability, since it advantageously acts in conjunction with the plate, which is arranged in a lower region of the basic body, to influence the stability of the door rack. By virtue of the plate latching onto the basic body, it is also attached thereto in a nondestructively removable manner. It can therefore also be installed and uninstalled quickly. By virtue of its latching on, a positionally secure mounting of the plate on the basic body is also possible. The configuration as a separate and hence removable plate is also very advantageous for cleaning purposes.

Moreover, the door rack not only allows items to be stored to be removed or inserted into the door rack via an upper opening, which is delimited by the rear wall and the upper bow, but also allows items to be stored to be removed or inserted into the door rack via the reach-through region. This means that items to be stored can also be inserted into the door rack or removed from the door rack at the side or at the front. The upper bow nonetheless creates a boundary, by means of which items to be stored are prevented from simply slipping or falling out of the door rack.

In an advantageous embodiment, the plate in its end position is arranged in a freely projecting manner at the forward side directed away from the rear wall or in a forward region relative thereto. This means that it is not covered or supported by additional further components in this frontal region or locally at side regions. In this frontal region and in partial side regions, the plate is therefore designed and arranged as a visible part of the door rack. By virtue of such a configuration, the number of parts is again reduced and accessibility to the door rack via the reach-through region is also maximized. Since the plate is so constructed as to have a very flat profile, the distance from the plate to the upper bow is maximal and is not reduced by other additional components arranged frontally or laterally on the plate. Moreover, a very pleasant optical impression is also created because the plate leaves a very filigree impression, and is therefore exposed and can be recognized at its front edge and parts of the side edges. If the material of the plate is specified, these specifications can be realized without restriction and are not concealed in any way.

Provision is preferably made for a receiving groove to be formed on a forward side of the rear wall directed towards the receiving volume of the door rack, into which a rear edge of the plate extends in its end position arranged on the basic body. This is a very advantageous embodiment because the plate can then be positioned very precisely and securely. Such a slot in the form of the receiving groove allows the plate to be readily mounted on the basic body and held in a lastingly secure manner.

In a particularly advantageous embodiment, provision is made for on-body latching elements of the latching device to be formed in the receiving groove. A system is thereby created which both allows effective latching on, and locally combines the mechanical holding devices formed by the latching elements and the receiving groove, such that a very space-saving configuration is also possible here. By virtue of this combination, insertion of the plate into the basic body then automatically also results in secure and reliable latching on when the plate with its lower edge is pushed or plugged into the receiving groove. Moreover, the latching elements formed on the basic body are then also so arranged as to be protected to a certain extent and can therefore also be protected against other unwanted shocks, such that they are likewise lastingly protected against damage and their functionality is therefore lastingly high.

Provision is preferably made for the receiving groove to have an upper boundary wall, on which on-body latching elements are molded or formed as integral parts. Latching elements can therefore be formed with positional accuracy and additional assembly expense is saved.

In particular, the basic body is formed from synthetic material as an integral part, in particular an injection molded part.

The receiving groove is delimited in an upward direction by the upper boundary wall and in a downward direction by a lower boundary wall. The lower boundary wall can preferably be formed flush with the lower edge of the rear wall. With regard to the positioning of the plate, this also allows the plate to be arranged as far down as possible on the basic body, whereby the receiving volume of the door rack is maximized and a distance between the plate and the upper bow is likewise maximized, and therefore the reach-through region is very advantageously configured for a user to reach through with a hand.

Provision is preferably made for the on-body latching elements of the latching device to be designed as raised ramps. This is very advantageous to the extent that the plate when pushed into the receiving groove is not confronted with an abrupt step which must be overcome in order to latch on, but the ramp here instead provides an approach slope over which the plate can slide in order to then snap in behind the rear side of the ramp and thereby form the latching connection.

The rear wall preferably has a perforation in the region of the latching elements in each case. Specifically, the manufacture as an integral part from synthetic material is thereby assisted since mold release is facilitated. In particular, the mold release of the latching elements is then simplified and significantly assisted with regard to the molding precision of these latching elements.

Viewed in the width direction of the door rack, the perforations preferably have a width which corresponds to the width of the respectively adjacent latching elements. In this width direction, the perforations are formed at precisely those positions where the respective latching elements are also formed.

The basic body preferably has side walls which converge with the rear wall. However, these side walls preferably extend over only part of the total dimension of the door rack as viewed in a depth direction of the door rack. This means that in an advantageous embodiment the upper bow extends forwards as viewed from these side walls. The upper bow therefore converges with said side walls at its free ends.

The basic body therefore has side walls which extend only partially over the depth of the bow, as measured in a depth direction of the door rack, and which converge with the rear wall. In particular, viewed in a width direction of the door rack, the receiving groove converges with these opposing side walls. This means that the receiving groove extends over the whole width of the rear wall, as measured in a width direction. By virtue of such a configuration, the stability of the basic body is increased. In the rear region of the receiving volume, an uninterrupted boundary is therefore realized not only over the full height of the door rack by virtue of the rear wall but also over a section of the door rack as viewed in a depth direction, to the extent that said side walls extend accordingly. The side walls likewise preferably extend over the full height of the rear wall. In particular, the reach-through region therefore extends at the front and in the side regions, being formed only as far as the front edges of the side walls in the side regions.

Provision is advantageously made for guiding grooves for the plate to be formed on inner sides of these side walls. By virtue of such a configuration, in addition to the receiving groove cited above, a further mechanical coupling is created separately at a different physical location, by means of which the plate is held with even greater stability. Viewed in a depth direction, these guiding grooves are preferably offset towards the front and are formed separately from the receiving groove, said guiding grooves being so designed as to be open towards the front at the front edges of the side walls. This allows the plate to be inserted easily and securely, and a corresponding guiding and holding device is achieved.

Provision is preferably made for the receiving groove to adjoin a lower edge of the rear wall, while nonetheless being delimited from below by a boundary wall.

Provision is preferably made for on-plate latching elements of the latching device to be formed on a surface of the plate. This means that on-plate latching elements can then advantageously latch directly onto on-body latching elements.

The on-plate latching elements are preferably integrated into the plate and therefore formed integrally therewith. Assembly expense can also be saved thereby and lasting positional certainty of the latching elements can be ensured.

The on-plate latching elements are preferably formed as latching wells. This is advantageous to the extent that no elements are formed on the plate which project upwards or from the plane of the plate, and against which other components or a user could knock when inserting or removing the plate. Moreover, such a negative form of the on-plate latching elements also ensures a quasi protected position of the latching elements in the plate.

In an advantageous embodiment, these on-plate latching elements are formed on an upper side of the plate, wherein said upper side is directed towards the upper bow in the installed state of the plate on the basic body. Assuming such a configuration, it is then also advantageous for the on-body latching elements to be formed on the upper boundary wall of the receiving groove.

In an alternative embodiment, provision can be made for the on-body latching elements to be formed on a lower boundary wall and the on-plate latching elements on a lower side of this plate.

The upper bow preferably has an attachment device for attaching a fascia panel which covers the bow at least locally and is separate from the upper bow. The fascia panel can be configured as a decor element.

In particular, the plate is formed from tempered glass. On the side walls preferably provided for the basic body, coupling structures can be formed on the outer sides directed away from the receiving volume, by means of which coupling structures the basic body and hence also the complete door rack can be attached to reciprocal coupling structures of a door of a household refrigeration appliance. In particular, such a coupling structure is formed on the basic body as an inverted U-shape.

Provision can be made for the basic body to be opaque. However, provision can also be made for the basic body to be transparent. Provision can also be made for the bottom plate to be opaque. The basic body and the plate can be of different colors or the same color.

In an advantageous embodiment, viewed in a depth direction of the door rack, provision is made for the coupling structure that is formed on the outside of the side walls in each case to be formed further back than the guiding grooves that are preferably provided on the inner sides of the side walls, said inner sides being directed towards the receiving volume. In particular, viewed in this depth direction, the guiding grooves and the coupling structure are so arranged as to overlap no further than a boundary rib which delimits the coupling structure. This coupling rib is the furthest forward as viewed in a depth direction, and is therefore the coupling rib directed towards the guiding groove.

The door rack preferably has a receiving well on an upper side of the plate, said upper side being directed towards the upper bow. By virtue of such a depression, the placement of items to be stored is made easier since they cannot then slip sideways out of the door rack through the reach-through region. By virtue of such a configuration of the plate, a quasi border is then created on the plate itself and integrated therein, said border forming a means of preventing items to be stored thereon from slipping off.

Furthermore, the invention also relates to a household refrigeration appliance comprising a housing and a receiving space which is formed therein for food and can be closed by a door. The household refrigeration appliance has at least one door rack in accordance with the aspect cited above or an advantageous configuration thereof, said door rack being arranged on an inner side of the door in particular, said inner side being directed towards the receiving space.

The specifications "upper", "lower", "front", "rear", "vertical", "depth direction", "width direction", "height direction" indicate the positions and orientations that are established when the appliance is used as intended and correctly arranged, and when an observer then stands in front of the appliance and looks in the direction of the appliance.

Further features of the invention are revealed in the claims, the figures and the description of the figures. The features and combinations of features cited above in the description, and the features and combinations of features cited below in the description of the figures and/or shown in the figures alone, can be used not only in the respectively indicated combination, but also in other combinations or individually without thereby departing from the scope of the invention. Therefore embodiments of the invention are also considered to be encompassed and disclosed which are not explicitly described or shown in the figures but are suggested by and can be derived from separate combinations of features in the embodiments described. Therefore embodiments and combinations of features are also considered to be disclosed which do not comprise all the features in an independent claim as originally drafted.

BRIEF DESCRIPTION OF THE SEVERAL VIEWS OF THE DRAWING

Exemplary embodiments of the invention are explained in greater detail below with reference to schematic drawings, in which.

DESCRIPTION OF THE INVENTION

Identical or functionally identical elements are denoted by the same reference signs in the figures.

Figure 1:
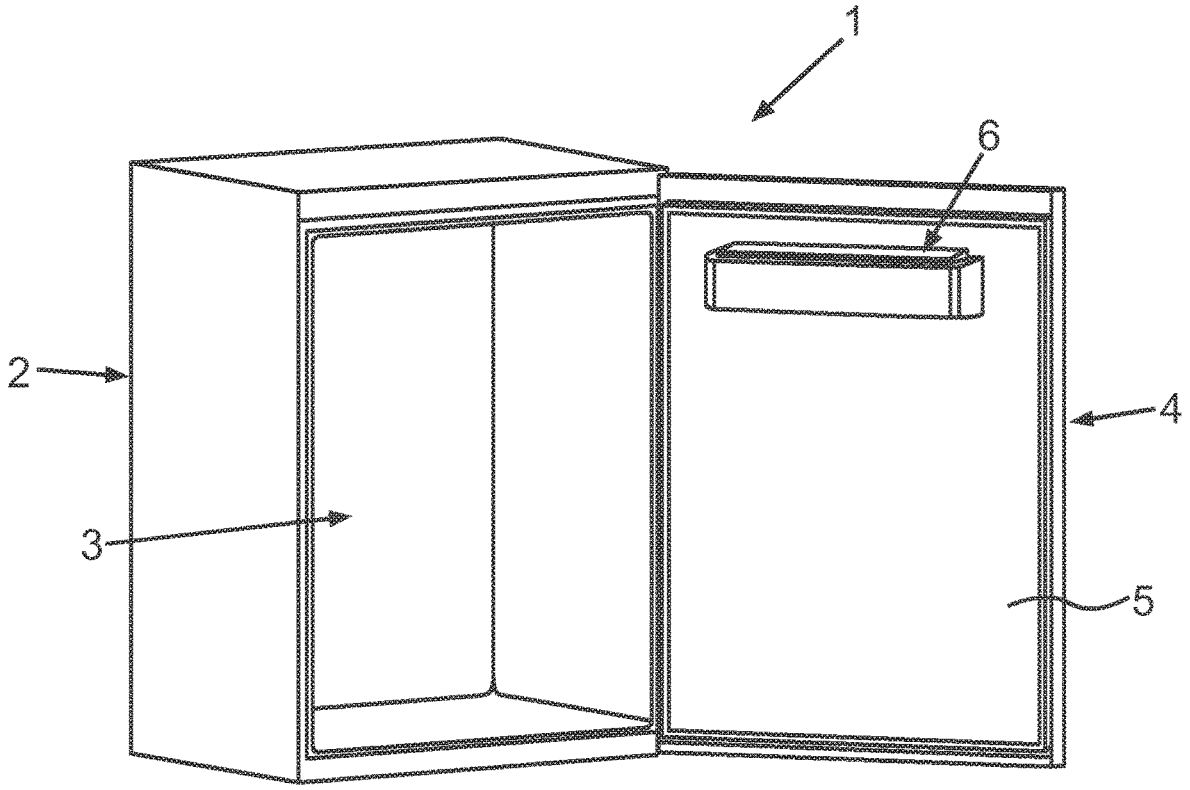
FIG. 1 shows a perspective view of an exemplary embodiment of a household refrigeration appliance according to the invention.

FIG. 1 shows a perspective view of a household refrigeration appliance 1 which can be, for example, a refrigerator or a freezer or a fridge-freezer and is designed to store and conserve food. The household refrigeration appliance 1 has a housing 2 in which is formed a receiving space 3 for food. The receiving space 3 can be closed by a door 4 on the front side. At least one door rack 6 is arranged on an inner side 5 of the door 4, which is directed towards the receiving space 3 in the closed state of the door 4.

Figure 2:
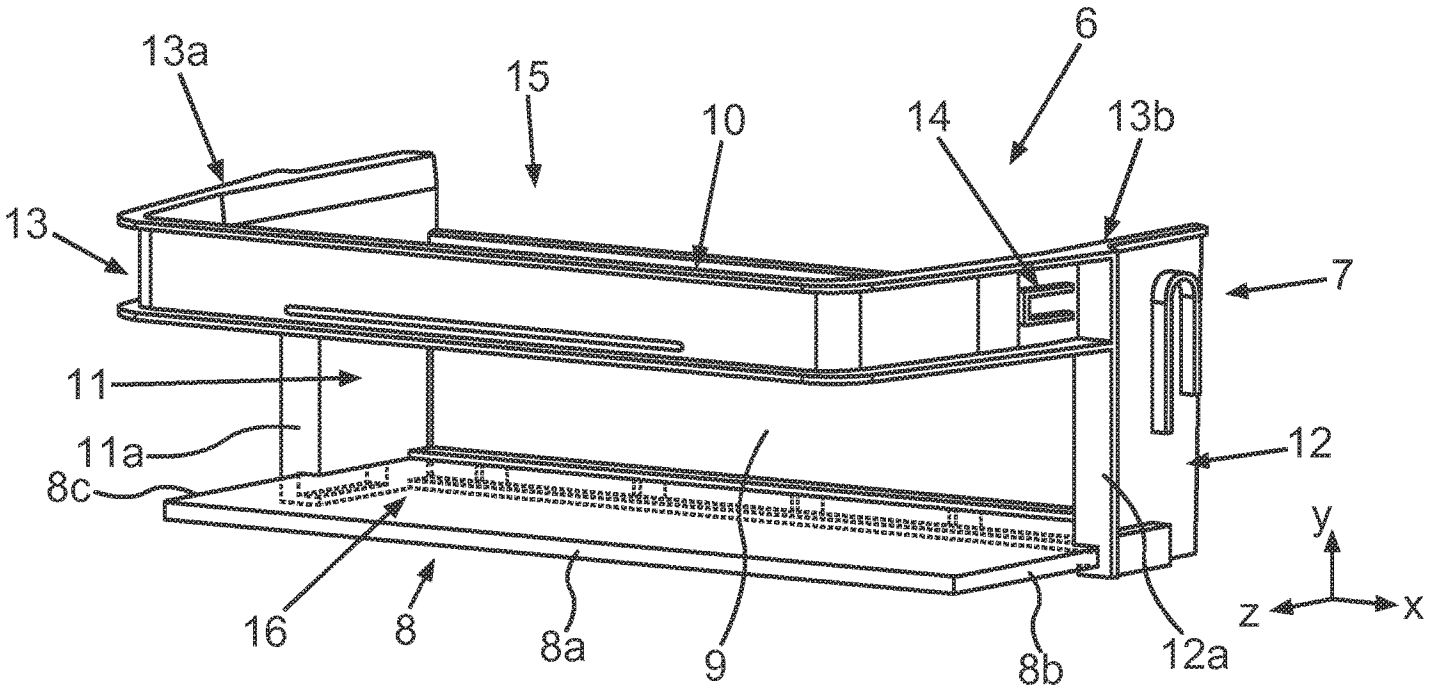
FIG. 2 shows a perspective view of an exemplary embodiment of a door rack according to the invention.

FIG. 2 shows a perspective view of an exemplary embodiment of the door rack 6. The door rack 6 has a basic body 7. The basic body 7 is preferably formed as an integral part, in particular from synthetic material. The door rack 6 also comprises a plate 8, which is designed as a bottom of the door rack 6 and represents a separate component from the basic body 7. FIG. 2 shows the assembled final state of the plate 8 on the basic body 7. The plate 8 is latched on to the basic body 7 by means of a latching device.

The door rack 6 is designed in such a way that the plate 8 extends over the entire width of the basic body 7 in a width direction (x-direction) which also corresponds to the width direction of the household refrigeration appliance 1. The basic body 7, which is shown separately from the plate 8 in FIG. 3, has a rear wall 9 that delimits a receiving volume 10 of the door rack 6 towards the rear. The basic body 7 also has side walls 11 and 12, which converge with the rear wall 9. The basic body 7 also has an upper bow 13, this being designed in a U-shape. In particular, this upper bow 13 forms the upper edge and therefore also the upper conclusion of the basic body 7, and therefore preferably of the door rack 6 likewise. At the ends thereof, said upper bow 13 converges with the side walls 11 and 12, in particular with front edges 11*a* and 12*a* of the side walls 11 and 12. In a depth direction, i.e. viewed in a z-direction of the door rack 6, the side walls 11 and 12 therefore extend only sectionally over the dimension of the basic body 7. The bow 13 therefore extends forwards from these front edges 11*a* and 12*a* of the side walls 11 and 12, which are directed away from the rear wall 9.

In a cross section perpendicular to its longitudinal axis, the upper bow 13 is formed as a channel which is U-shaped in particular. By virtue of this configuration, the mechanical stability and torsional rigidity thereof is increased. Moreover, it is advantageous by virtue of such a configuration to form an attachment device 14 in this channel region, wherein a fascia panel or decor element (not shown) which is separate from the basic body 7 can be attached to said attachment device 14. The upper bow 13 is covered at least locally at the front and at the sides by this fascia panel.

It can also be seen in FIG. 2 that the door rack 6 has a loading opening 15 which is open towards the top and is delimited by the rear wall 14, the side walls 11 and 12 and the upper bow 13. By virtue of this loading opening 15, items to be stored can be inserted into or removed from the receiving volume 10 from above.

In particular, provision is also made for the door rack 6 to have a reach-through region 16 at the front and at the sides. This is delimited in a height direction (y-direction) by the upper bow 13 above and by the plate 8 below. By virtue of this reach-through region 16, it is also possible to reach into the receiving volume 10 from the side and the front, and the removal or insertion of items to be stored can also be effected via this reach-through region 16. The reach-through region 16 is therefore not covered by a component.

It can also be seen in FIG. 2 that the plate 8 is so designed as to be exposed at its forward edge 8*a* and partially at side edges 8*b* and 8*c*, and is therefore arranged in a freely projecting manner towards the front and the side in this respect. This means that the plate 8 is not covered by a further component at the front or at these parts of the side regions. In this respect, the plate 8 is so arranged as to be freely suspended towards the front. It is therefore no longer supported from below or above or otherwise retained in these regions.

Figure 3:
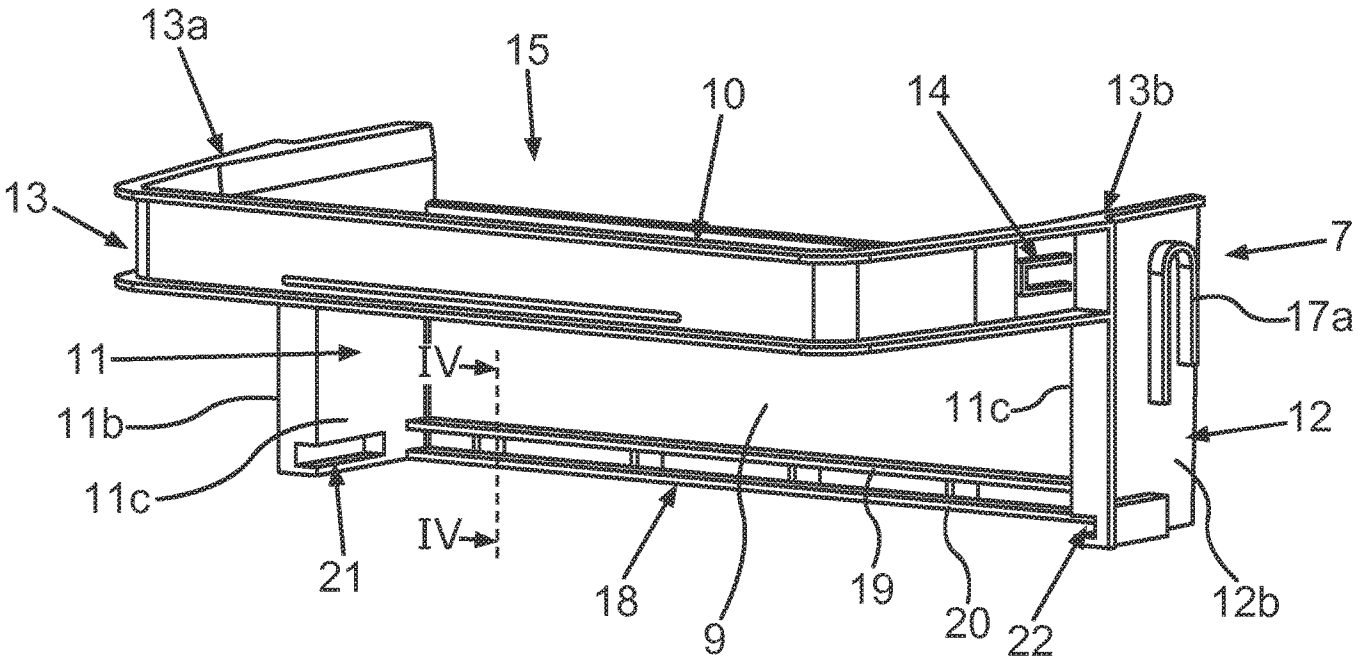
FIG. 3 shows a perspective view of a basic body of the door rack as per FIG. 2.

The basic body 7, also shown in FIG. 3, has a coupling structure on each of the outer sides 11*b* and 12*b* directed away from the receiving volume 10, wherein only the coupling structure 17*a* on the outer side 12*b* is visible in FIG. 2 and FIG. 3. This coupling structure 17*a* is designed as a raised rib which has an inverted U-shape. By means of this coupling structure 17*a*, the door rack 6 can be attached to a reciprocal coupling structure on the inner side 5.

A receiving groove 18 is formed in the basic body 7. The receiving groove 18 is delimited by an upper boundary wall 19 and a lower boundary wall 20. The receiving groove 18 is formed on the rear wall 9 in the lower region thereof. The receiving groove 18 extends over the entire width of the rear wall 9 and converges with inner sides 11*c* and 12*c* of the side walls 11 and 12. The receiving groove 18 is so designed as to be open towards the front, as visible in FIG. 2, in order to receive the rear edge of the plate 8. Moreover, on the inner side 11*c* of the side wall 11 is formed a guiding groove 21 which, as viewed in a depth direction, ends in front of the receiving groove 18 but is open at the front edge 11*a* of the side wall 11. A similarly formed guiding groove 22 is correspondingly formed on the inner side 12*c* of the side wall 12.

Figure 4:
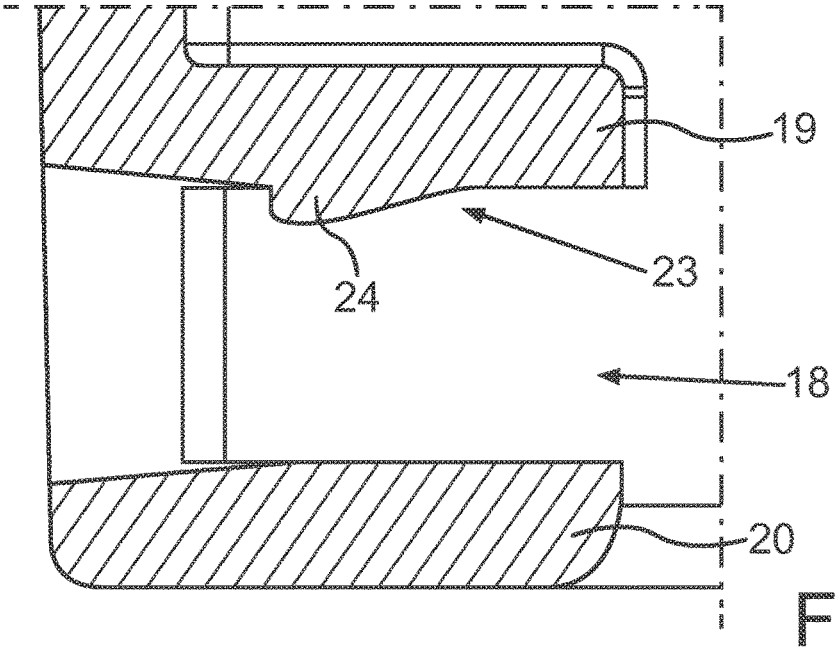
FIG. 4 shows a vertical-section view of a partial region of the basic body of the door rack as per FIG. 2.
Figure 8:
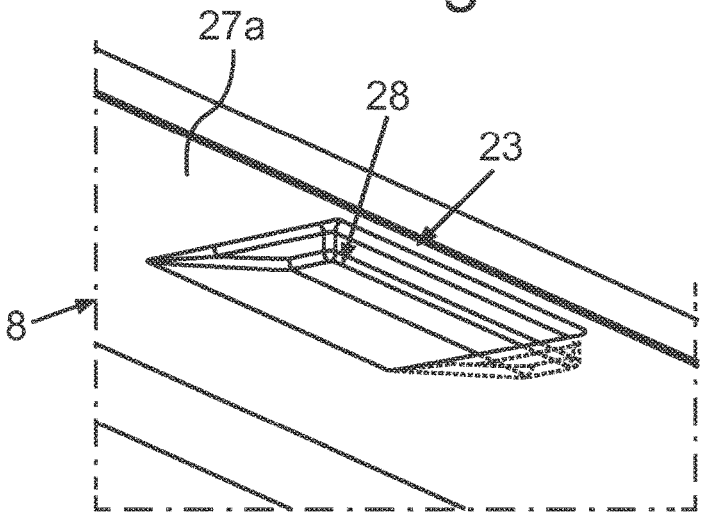
FIG. 8 shows a partial view of an exemplary embodiment of a plate designed as a bottom of the door rack.

The door rack 6 has a latching device 23 (FIG. 4 and FIG. 8). By virtue of the latching device 23, the plate 8 is arranged on the basic body 7 in a latched manner.

In particular, provision is made for the latching device 23 to be formed with on-body latching elements in the receiving groove 18.

Concerning this, FIG. 4 shows a vertical-section view (y-z sectional plane) of the basic body 7 as per FIG. 2 and FIG. 3 in the region of the receiving groove 18. FIG. 4 shows a section view along an intersection line IV-IV in FIG. 3. It is evident in this exemplary embodiment that on-body latching elements 24, particularly in the form of ramps, are formed in an integrated manner on the upper boundary wall 19. However, the on-body latching elements 24 can also be formed on the lower boundary wall 20, for example.

It is evident in FIG. 4 that the latching elements 24 are provided as raised elements which extend into the receiving groove 18.

Figure 5:
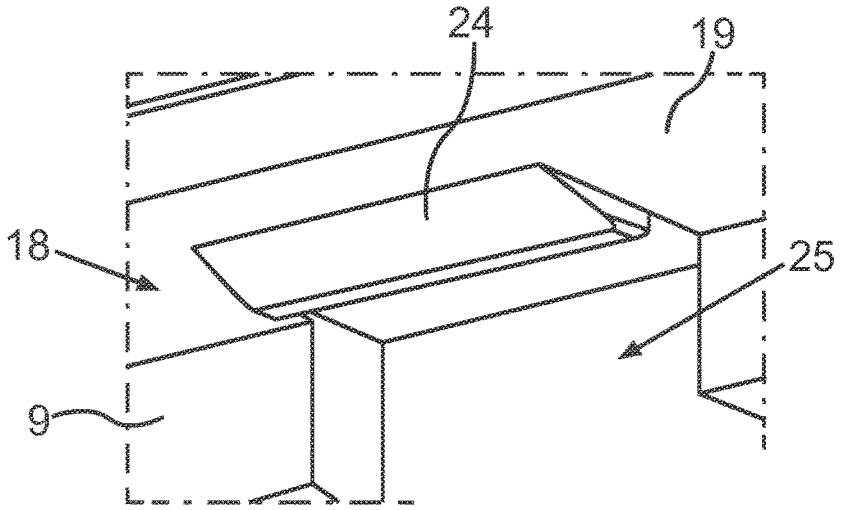
FIG. 5 shows a perspective view of the partial region as per FIG. 4.

FIG. 5 shows a perspective view of the partial section as per FIG. 4.

It is evident in FIG. 5, and in FIGS. 2 and 3, that the rear wall 9 has perforations 25 at those points where the latching elements 24 are formed, by means of which perforations 25 the mold release of the latching elements 24 is assisted when manufacturing the basic body 7.

Figure 6:
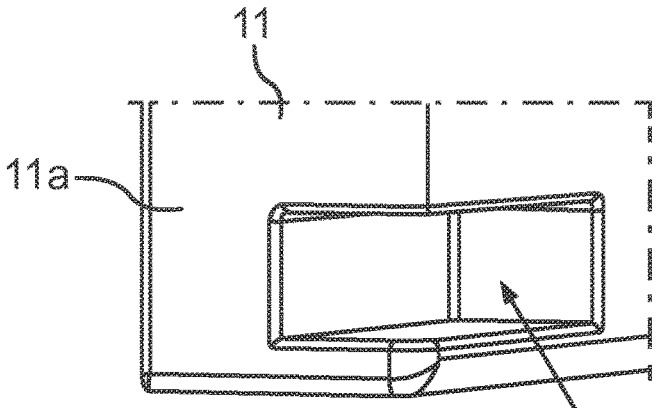
FIG. 6 shows a magnified perspective view of a further partial region of the basic body of the door rack as per FIG. 2.

FIG. 6 shows a magnified view of the side wall 11, such that the guiding groove 21 can be identified more precisely here.

Figure 7:
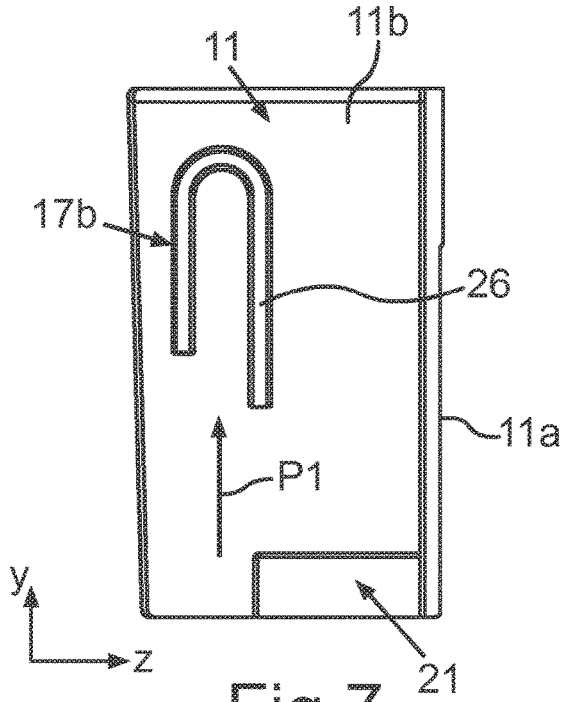
FIG. 7 shows a side view of a partial region of the basic body of the door rack as per FIG. 2.

It is evident in FIG. 7, which shows a side view of the side wall 11, that there is practically no overlap as viewed in a depth direction between the coupling structure 17*b* and the guiding groove 21 shown there. If necessary, a maximum degree of overlap is specified by a boundary rib 26 of the coupling structure 17*b*, wherein said coupling rib 26 is that rib region of the coupling structure 17*b* which is furthest forward as viewed in a depth direction. By virtue of such a configuration between the coupling structure 17*b* and the guiding groove 21, installation of the door rack 6 on the inner side 5 is simplified because the door 6 can also be installed on the door 4 from above and the reciprocal coupling structure, in particular a catch, does not have to be threaded between the guiding groove 21 and the coupling structure 17*b*. A simple linear sliding movement downwards from above can then be performed by introducing the reciprocal coupling structure into the coupling structure 17*b* in the direction of the arrow P1, since the guiding groove 21 is not in the way in this direction.

FIG. 8 shows a partial view of the plate 8 with surfaces that are formed by an upper side 27*a* and a lower side 27*b*. Shown here is a view of an upper side 27*a* which is directed towards the upper bow 13. In the exemplary embodiment, an on-plate latching element 28 of the latching device 23 is formed as an integral part and therefore integrated into this upper side 27*a*. This on-plate latching element 28 is a latching well, which is therefore formed as a predefined indentation in this upper side 28. In particular, the shape of this on-plate latching element 28 is complementary to the shape of the on-body latching element 24, such that a perfect fit of the on-body latching element 24 and the on-plate latching element 28 is achieved in the latched-on state.

Figure 9:
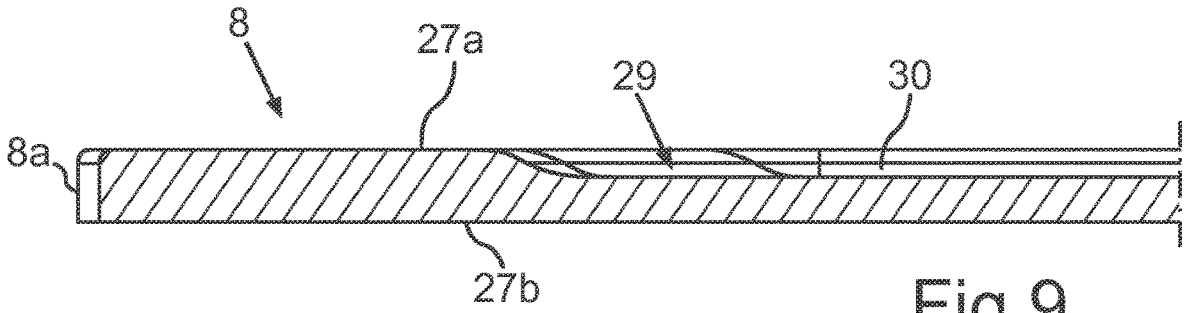
FIG. 9 shows a section view through an exemplary embodiment of a plate designed as a bottom of the door rack.

FIG. 9 shows a partial view of the plate 8 in cross section. It is evident that the upper side 27*a* has a receiving well 29 which is formed separately from the latching elements 28, the latter being designed as latching wells. By virtue of this receiving well 29, a placement region is created for items to be stored. By virtue of this receiving well 29, which is delimited by edge ribs 30, a structure is created in the plate 8 itself which prevents items to be stored from slipping off the upper side 27*a*.

As shown and explained with reference to FIG. 2, the plate 8 is guided by its side regions into the guiding grooves 21 and 22 when it is inserted, and is then also held therein in the installed end position. The receiving groove 18 on the rear side, and the latching device 23 which is preferably formed therein, together with these additional and separate guiding grooves 21 and 22, provide a stable holding device for the plate 8 even though it is so arranged as to project freely forwards.

LIST OF REFERENCE SIGNS

1 Household refrigeration appliance
2 Housing
3 Receiving space
4 Door
5 Inner side
6 Door rack
7 Basic body
8 Plate
8*b* Side edge
8*c* Side edge
9 Rear wall
10 Receiving volume
11 Side wall
11*a* Front edge
11*b* Outer side
11*c* Inner side
12 Side wall
12*a* Front edge
12*b* Outer side
12*c* Inner side
13 Bow
14 Attachment device
15 Loading opening

16 Reach-through region
17*a* Coupling structure
17*b* Coupling structure
18 Receiving groove
19 Boundary wall
20 Boundary wall
21 Guiding groove
22 Guiding groove
23 Latching device
24 Latching elements
25 Perforations
26 Coupling rib
27*a* Upper side
27*b* Lower side
28 On-plate latching element
29 Receiving well
30 Edge ribs

The invention claimed is:

1. A door rack for a household refrigeration appliance, the door rack comprising:

a basic body configured for receiving items to be stored, a rear wall, and a forwardly oriented upper bow directed away from said rear wall of said basic body;

a plate that is separate from said basic body and forms a bottom of the door rack; and a latching device configured for latching said plate on said basic body;

said upper bow and said plate forming a reach-through region therebetween in an end position of said plate wherein said plate is latched on said basic body;

said rear wall being formed with a receiving groove into which a rear edge of said plate extends in the end position of said plate latched on said basic body, said receiving groove has an upper boundary wall;

said latching device having latching elements formed as integral parts on said boundary wall of said receiving groove.

2. The door rack according to claim 1, wherein said latching elements are raised ramps.

3. The door rack according to claim 1, wherein said rear wall is formed with recesses in a region of said latching elements.

4. The door rack according to claim 1, wherein said basic body has side walls that converge with said rear wall and that are formed with forward edges directed away from said rear wall, and wherein said upper bow converges with said side walls at said front edges.

5. The door rack according to claim 4, wherein said side walls have inner sides formed with guiding grooves for said plate.

6. The door rack according to claim 5, wherein said guiding grooves end in front of said receiving groove as viewed in a depth direction.

7. The door rack according to claim 1, wherein the receiving groove adjoins a lower edge of said rear wall.

8. The door rack according to claim 1, wherein said latching device comprises on-plate latching elements formed on a surface of said plate.

9. The door rack according to claim 8, wherein said on-plate latching elements are latching wells.

10. The door rack according to claim 1, wherein an upper side of said plate has a receiving well integrally formed therein.

11. The door rack according to claim 1, wherein said upper bow has an attachment device for attaching a fascia panel for covering said upper bow at least locally.

12. A household refrigeration appliance, comprising:

a housing having a receiving space for receiving food;

a door for closing said receiving space; and at least one door rack according to claim 1 disposed on an inner side of said door.

* * * * *